US012226680B2

(12) United States Patent
Ilhan et al.

(10) Patent No.: US 12,226,680 B2
(45) Date of Patent: Feb. 18, 2025

(54) INTERACTIVE SPORTS TRAINING SYSTEM AND METHOD

(71) Applicant: Omer Faruk Ilhan, Ankara (TR)

(72) Inventors: Omer Faruk Ilhan, Ankara (TR); Melik Firat Ilhan, Ankara (TR); Cagatay Afsar, Izmir (TR)

(73) Assignee: Omer Faruk Ilhan, Ankara (TR)

( * ) Notice: Subject to any disclaimer, the term of this patent is extended or adjusted under 35 U.S.C. 154(b) by 877 days.

(21) Appl. No.: 16/622,302

(22) PCT Filed: Aug. 29, 2019

(86) PCT No.: PCT/TR2019/050717
§ 371 (c)(1),
(2) Date: Dec. 13, 2019

(87) PCT Pub. No.: WO2021/040637
PCT Pub. Date: Mar. 4, 2021

(65) Prior Publication Data

US 2021/0316197 A1 Oct. 14, 2021

(51) Int. Cl.
*A63B 63/08* (2006.01)
*A63B 63/00* (2006.01)
(Continued)

(52) U.S. Cl.
CPC ..... *A63B 63/083* (2013.01); *A63B 63/004* (2013.01); *A63B 69/002* (2013.01);
(Continued)

(58) Field of Classification Search
CPC ..... A63B 69/002; A63B 69/0046; A63B 69/0071; A63B 60/56; A63B 55/00;
(Continued)

(56) References Cited

U.S. PATENT DOCUMENTS 2,922,653 A * 1/1960 Edward ..... A63B 63/00 403/171
5,634,638 A * 6/1997 Havens ..... A63B 71/022 473/421
(Continued)

FOREIGN PATENT DOCUMENTS

CN 209173328 U * 7/2019
CN 210543204 U * 5/2020
(Continued)

OTHER PUBLICATIONS

Peng Translation.*
Corchero Translation, All Pages (Year: 2011).*
Chen Translation (Year: 2020).*

*Primary Examiner* — Jeffrey S Vanderveen
(74) *Attorney, Agent, or Firm* — Bayramoglu Law Offices LLC

(57) ABSTRACT

An interactive sports training system, including a basketball hoop on a basketball platform, a metal structure connected to the basketball hoop, a main post connected to the basketball hoop and the metal structure, a plurality of back structure bars connected to the main post, a plurality of foldable ground construction bars connected to the main post, a plurality of side nets positioned to form a triangular structure with the main posts and the plurality of foldable ground construction bars connected to the main post, a football post located in a football platform, and a plurality of metal bars. The plurality of metal bars provide connection of the plurality of side nets with a telescopic net carrier structure.

1 Claim, 6 Drawing Sheets

(51) Int. Cl.
*A63B 69/00* (2006.01)
*A63B 71/02* (2006.01)
*A63B 71/06* (2006.01)

(52) U.S. Cl.
CPC ..... *A63B 69/0046* (2013.01); *A63B 69/0071* (2013.01); *A63B 71/023* (2013.01); *A63B 71/0669* (2013.01); *A63B 2071/025* (2013.01); *A63B 2214/00* (2020.08); *A63B 2220/801* (2013.01); *A63B 2220/806* (2013.01); *A63B 2220/833* (2013.01); *A63B 2225/20* (2013.01); *A63B 2225/74* (2020.08); *A63B 2243/0025* (2013.01); *A63B 2243/0037* (2013.01); *A63B 2243/0054* (2013.01)

(58) Field of Classification Search
CPC ... A63B 47/00; A63B 71/023; A63B 71/0036; A63B 71/022; A63B 71/02; A63B 2071/025
USPC ..... 473/476
See application file for complete search history.

(56) References Cited

U.S. PATENT DOCUMENTS 5,681,045 A * 10/1997 Liao ..... A63B 63/004 403/92
6,550,491 B1 * 4/2003 Bixler ..... E04H 15/52 135/912
6,652,395 B2 * 11/2003 Goldwitz ..... A63B 63/004 473/476
8,356,818 B2 * 1/2013 Mraz ..... F41J 5/041 273/378
10,653,938 B1 * 5/2020 Traustason ..... A63B 63/00
2005/0275168 A1 12/2005 Kegevic
2006/0148599 A1 7/2006 Haddix
2009/0005196 A1 * 1/2009 Kessler ..... A63B 63/00 473/476
2012/0252607 A1 * 10/2012 Shepherd ..... A47B 83/024 473/483
2013/0331208 A1 * 12/2013 Elpers ..... A63B 71/022 473/476
2016/0193518 A1 * 7/2016 Baxter ..... A63B 21/0442 473/483
2019/0076713 A1 * 3/2019 Cuenin ..... G07C 1/22
2019/0160356 A1 5/2019 Lalaoua

FOREIGN PATENT DOCUMENTS

FR 2956820 A1 * 9/2011 ..... A63B 69/002
WO 2013027064 A2 2/2013
WO 2018121038 A1 7/2018

* cited by examiner

INTERACTIVE SPORTS TRAINING SYSTEM AND METHOD

CROSS REFERENCE TO THE RELATED APPLICATIONS

This application is the national phase entry of the International Application No. PCT/TR2019/050717, filed on Aug. 29, 2019, the entire contents of which are incorporated herein by reference.

TECHNICAL FIELD

The invention is related to providing an interactive sports training system and method which can turn all kinds of sports involving shooting balls, such as football, basketball and bowling into universal entertainment by means of size adjustable, portable football posts and baskets.

BACKGROUND

Several studies can be observed in the art that are related to portable football posts and basketball hoops.

In the United States patent document numbered US2005275168A1 of the known prior art a football post whose size can be adjusted is disclosed. Said football post has a cornered frame and pipe elements that have been attached such that they can be replaced with each other which enable to adjust the size and disassemble the frame.

In the United States patent document US2006148599A1 of the prior art, a sports training target device for training a person to throw a ball is disclosed. The height of said device is adjustable.

In the United States patent document numbered US2019160356A1 of the prior art a multimedia stadium football post is disclosed. In this document it has been mentioned that the goals are recorded via cameras In the International patent document numbered WO2013027064A2 of the prior art a sports training apparatus for football training is disclosed. Said apparatus comprises a shooting area limited with side walls and the end wall comprising a football post.

In the International patent document numbered WO2018121038A1 of the prior art a mobile football post is disclosed. The frames of said football post are connected such that they can be assembled and disassembled to and from each other.

When the present systems comprising football posts and basketball hoops are examined it has been noticed that an interactive sports training system and method where the size of the football post and basketball hoop can be changed, all of the shot/goal statistics of the users can be recorded and the football/basketball shots can be captured and recorded by camera from different angles was required.

SUMMARY

The main aim of the invention is to provide an interactive sports training system and method where the size of the football post and basketball hoop can be adjusted.

The main aim of the invention is to provide an interactive sports training system and method where the height and size of the football post and basketball hoop can be adjusted.

Another aim of the invention is to provide an interactive sports training system and method where the football and basketball shots are captured and recorded by the camera from different angles.

Another aim of the invention is to provide an interactive sports training system and method where the statistical data obtained by means of cameras are recorded.

BRIEF DESCRIPTION OF THE DRAWINGS

The sports training system carried out in order to reach the aims of the invention have been illustrated in the attached figures.

According to the figures.

Figure 1:
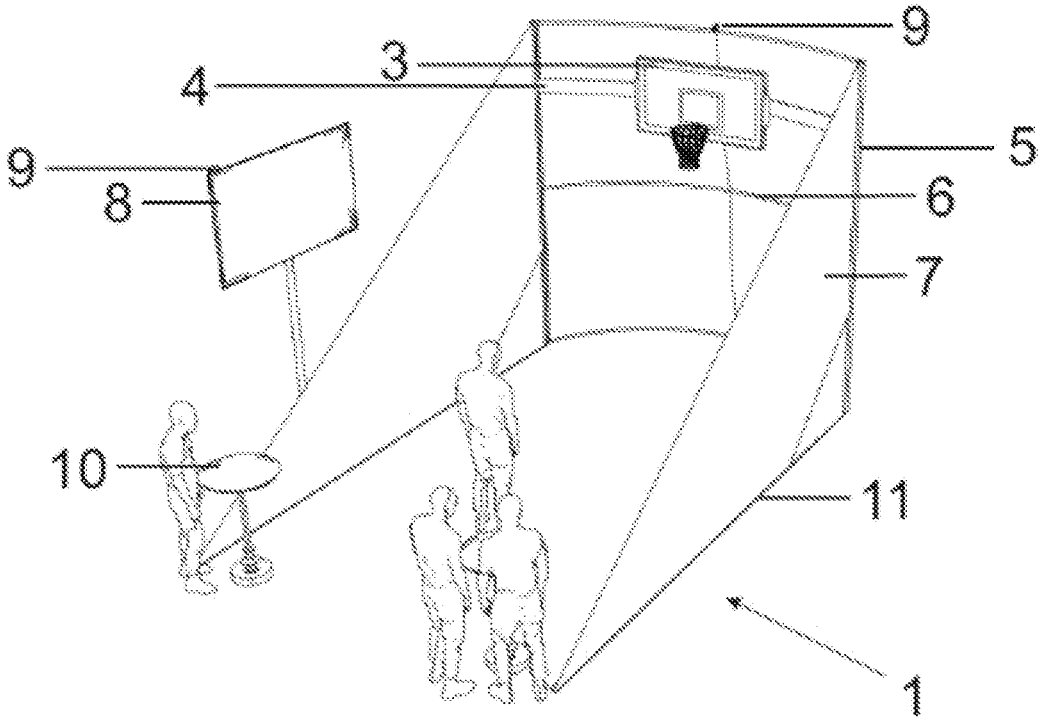
FIG. 1 shows a three dimensional perspective view of the basketball platform provided in the system subject to the invention.
Figure 2:
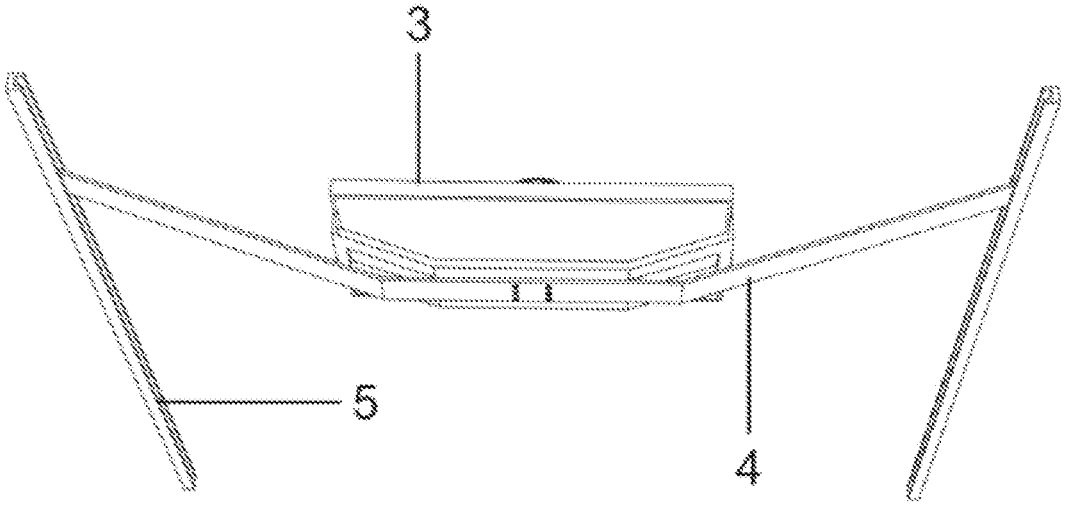
FIG. 2 shows a rear view of the basketball hoop provided in the basketball platform in the system subject to the invention.
Figure 3:
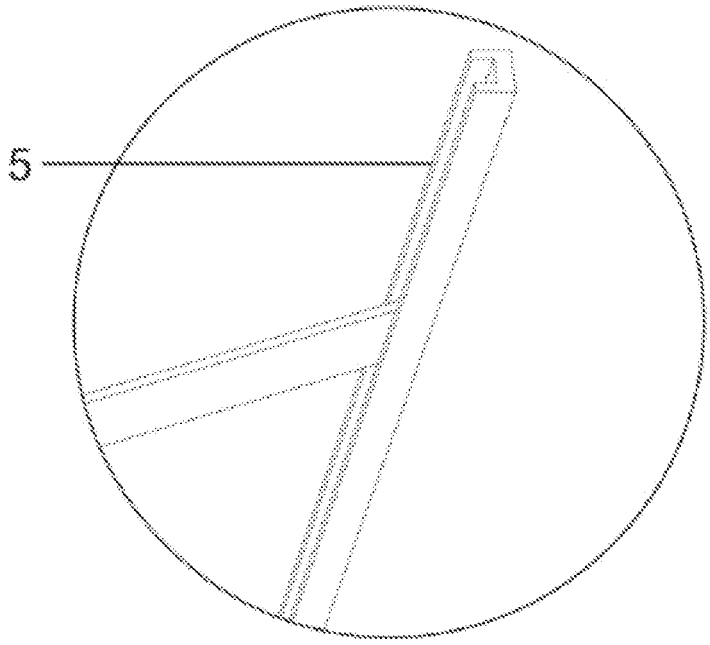
FIG. 3 shows detailed view of the main post of the basketball hoop provided in the system subject to the invention.
Figure 4:
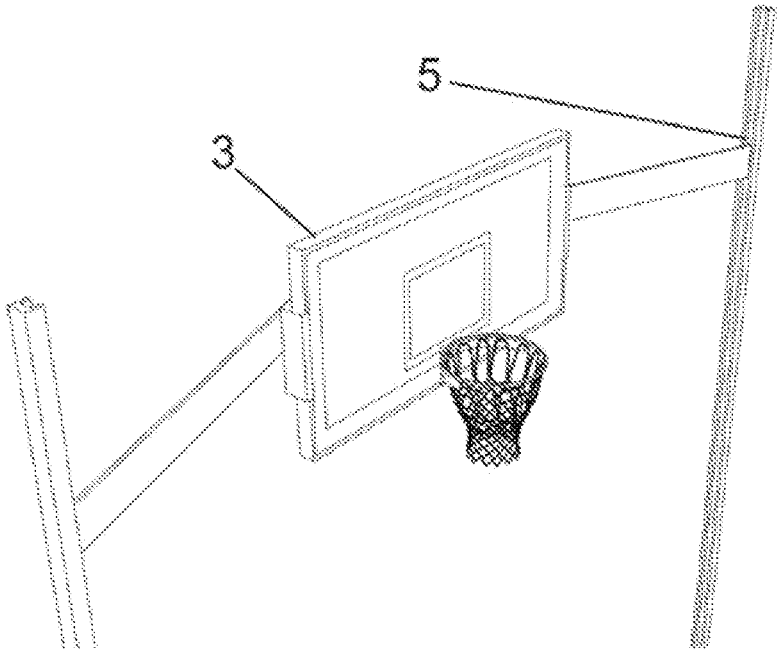
FIG. 4 shows a perspective view from a different angle, of the basketball hoop provided in the system subject to the invention.
Figure 5:
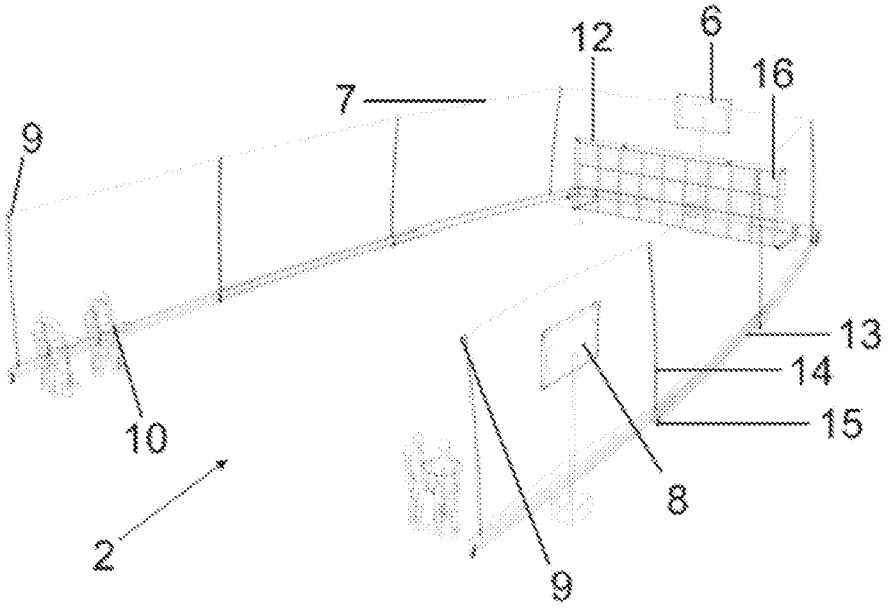
FIG. 5 shows a three dimensional perspective view of the football platform located in the system subject to the invention.
Figure 6:
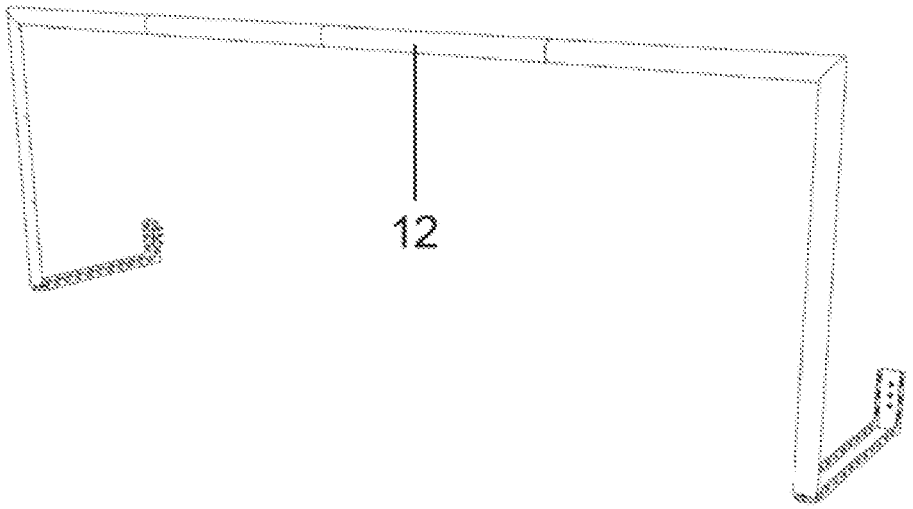
FIG. 6 shows a perspective view of the football post located on the football platform provided in the system subject to the invention.
Figure 7:
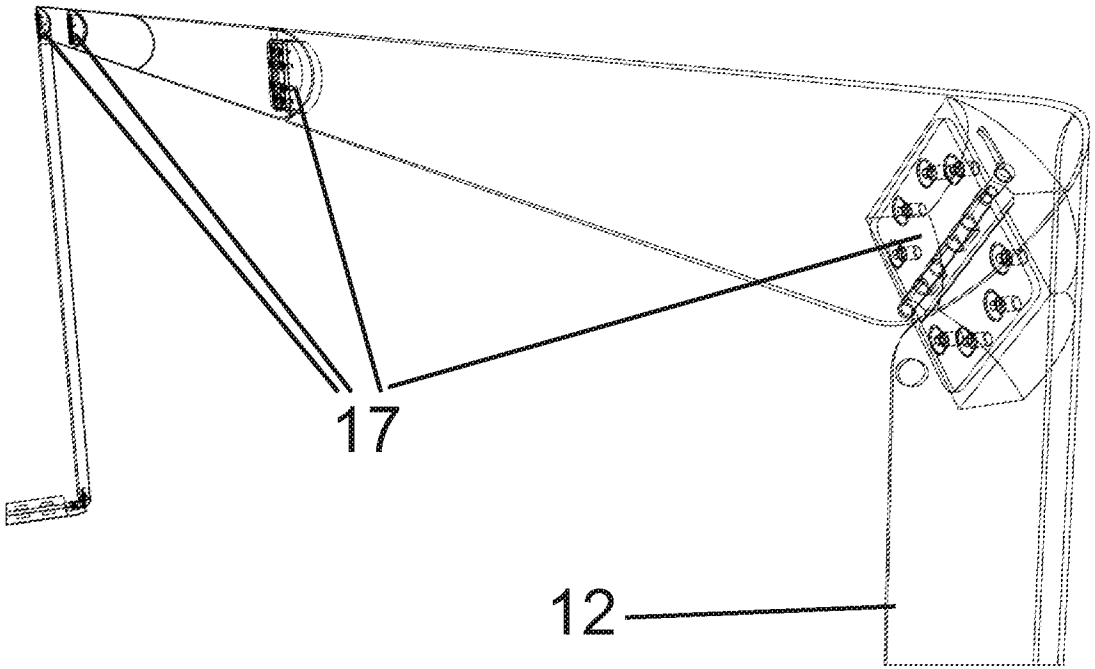
FIG. 7 shows a sectional view of the football post provided in the system subject to the invention.
Figure 8:
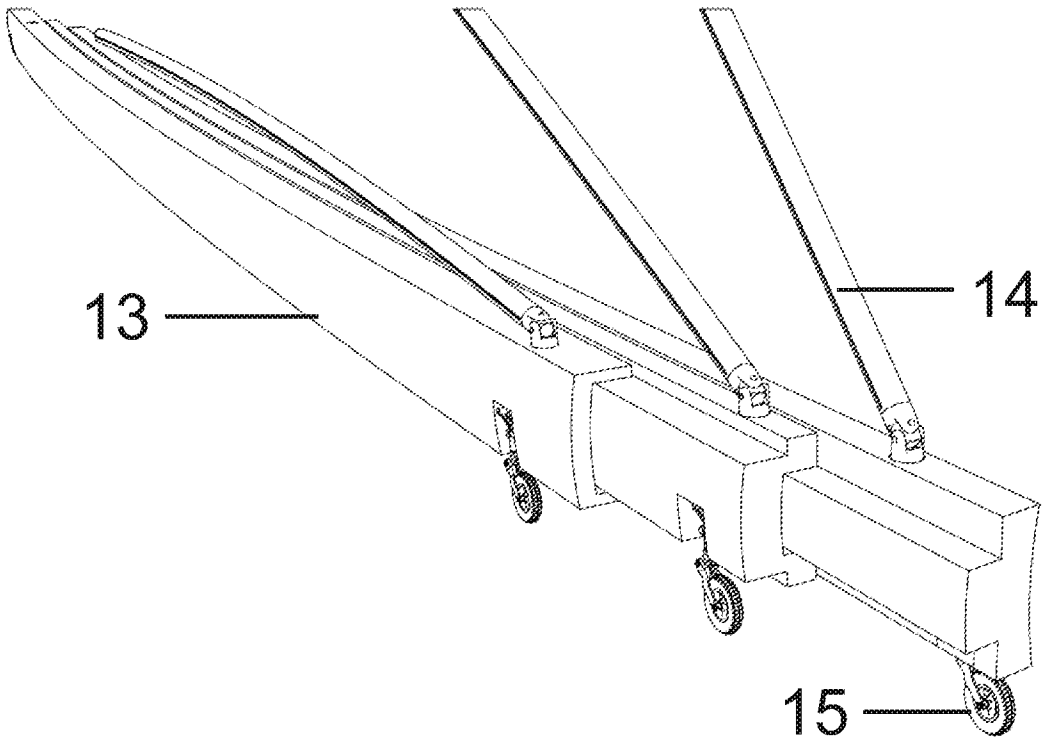
FIG. 8 shows a perspective view of the mobile mechanism located in the football platform available in the system subject to the invention.
Figure 9:
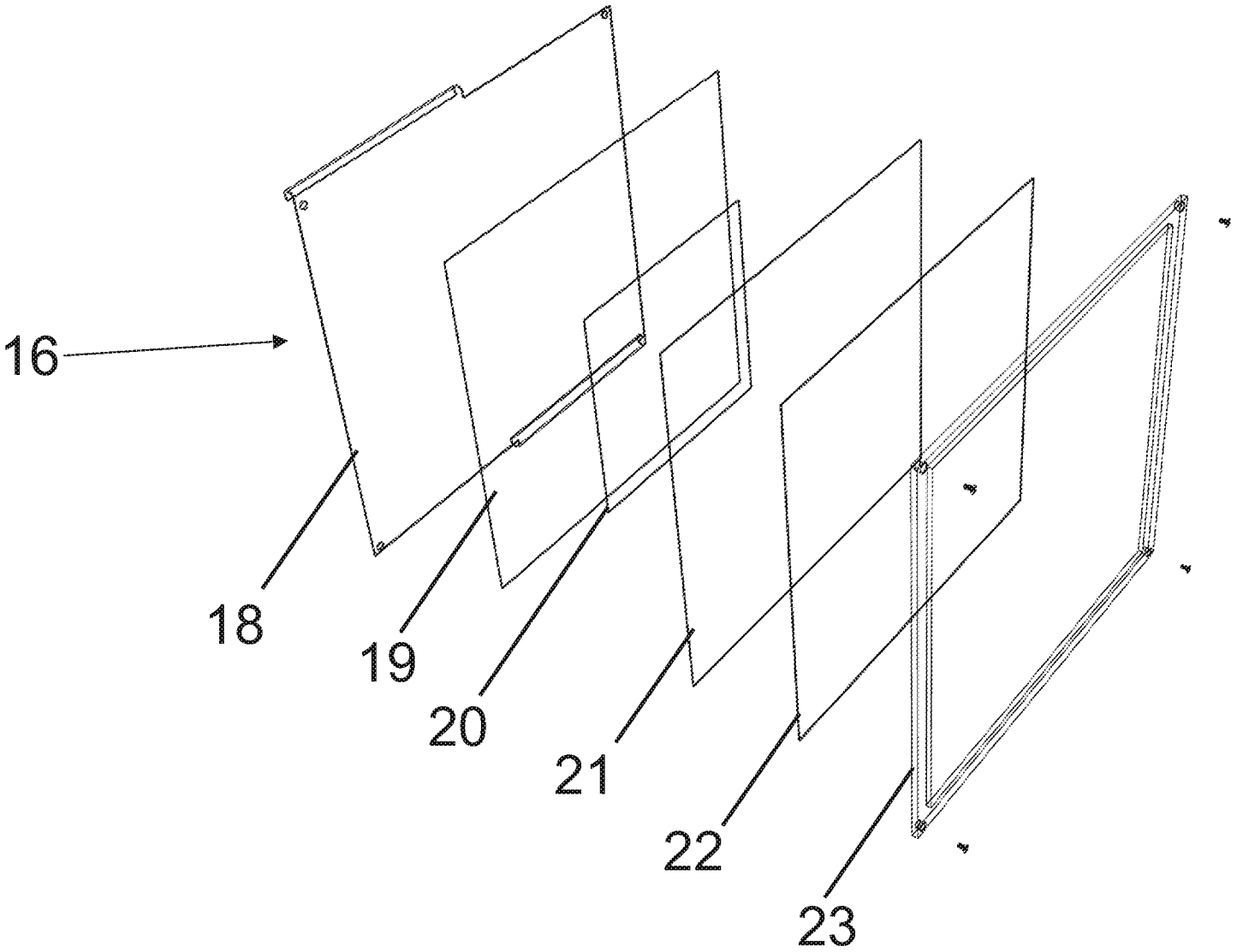
FIG. 9 shows a blown up view of the score plates located in the football platform available in the system subject to the invention.

The parts in the figures have each been numbered and the references of each number have been provided below.

1. Basketball platform
2. Football platform
3. Basketball hoop
4. Metal construction
5. Main posts
6. Back structure bars
7. Side nets
8. Score board
9. Video recorder
10. Service table
11. Ground construction bar
12. Football post
13. Telescopic net carrier structure
14. Metal bars
15. Wheels
16. Touch resistive scoring plates
17. Hinges
18. Hanging metal backplate
19. Back circuit layer
20. Resistive touch layer
21. LED layer
22. Protective plastic layer
23. Metal housing frame

DETAILED DESCRIPTION OF EMBODIMENTS

The invention is an interactive sports training system, comprising the parts of, a basketball hoop (3) on a basketball platform (1), a metal construction (4) connected to the basketball hoop (3), main post (5) connected to the basketball hoop (3) and metal structure (4), back structure bars (6) connected to the main post (5), side nets (7) positioned to form a triangular structure with the main posts (5) and ground construction bars (11) connected to the main post (5), a scoreboard (8) fixed to ground construction bars (11), a video recorder (9) mounted to the score board (8) and basketball hoop (3), a service table (10) provided in the system, foldable ground construction bars (11) connected to the main post (5), a football post (12) located in the football platform (2), a telescopic net carrier structure (13) connected to the side nets (7) provided in the football platform (2), metal bars (14) that provide connection of the side nets (7) with the telescopic net carrier structure (13), a wheel (15) positioned under the telescopic net carrier (13), a score board (16) positioned behind the football posts (12), a hinge (17) located in the football posts (12), a metal back plate (18) located inside the score board (16), a back circuit layer (19) located in the score board (16) and provided on the metal back plate (18), a resistive touch layer (20) located in the back circuit layer (19) disposed in the score plate (16), a LED layer (21) located on the resistive touch layer (20) disposed in the score plate (16), a protective plastic layer (22) located on the LED layer (21) disposed in the score plate (16), a metal housing frame (23) located on the protective plastic layer (22) disposed in the score plate (16).

In the system subject to the invention the basketball hoops (3) shall be used in standard sizes, but their height on the main post (5) can be raised or lowered. In the system subject to the invention the metal structure (4) carries the basketball hoop (3) and provides the coupling between the basketball hoop (3) and the main post (5).

The main post (5) in the system subject to the invention is formed of metal posts that carry the motor which enables adjustment of the system and the basketball hoop (3). In the system subject to the invention the back structure bars (6) is a piece which prevents the main post (5) from toppling backwards, onto which side nets (7) that prevent the ball from escaping are mounted. The back structure bars (6) consume less space due to their curved structures and are sturdier.

In the system subject to the invention the score board (8) has internet connection. By this means the scores that the users have obtained can be observed live. By means of the video recorder (9) in the system subject to the invention the motions of the users are recorded.

In the system subject to the invention service tables (10) for consuming food and beverages are provided for the opponents or guests.

In the system subject to the invention the ground construction bars (11) are connected to the main post (5) and are foldable. The ground construction bars (11) prevent the main post (5) from toppling backwards and they support the side nets (7).

The football post (12) of the system subject to the invention can be opened and closed by being folded with the aid of hinges (17) provided on different points, and the height and the width of the post is adjustable.

In the system subject to the invention, a telescopic net carrier structure (13) is provided which allows the telescopic structured metal parts to be raised and lowered in height and onto which side nets (7) are mounted. In the system subject to the invention the ball is prevented from escaping from the sides or the back by means of the metal bars (14).

In the system subject to the invention the easy lowering and raising of the system telescopic net carrier structure (13) is enabled via the wheels (15). The score plates (16) provided in the system subject to the invention is a modular piece that is mounted later on between the football posts. The resistive touch layer (20) inside the score plates (16) detects the impact of the ball. By means of the LED layer (21) located on the resistive touch layer (20), the score at the point where the ball comes into contact with is displayed.

The invention is an interactive sports training method, comprising the following steps;

the application is installed into the communication system,

"The nearest Shot Court" button on the application is pressed, the application determines the closest platform via navigation, the user goes to the closest platform, a data confidentiality agreement is signed with the user, photos of the user is taken in order to prevent fake membership and spam user records and the membership is activated with real information, the sports and shooting halls that the user can use are shown to the user, the user selects the hall and sports type; such as football, basketball, bowling, etc., the user changes clothes and goes to the shooting hall, the application is synchronized with the shooting hall selected by the user (in the synchronization process, the personnel at the application desk manually synchronizes the identity of the user and the selected hall number from the computer screen and the video records of the related halls that are activated as a result of synchronization are recorded to the ID of the user), the user activates the application and selects the shooting preference from the list, following this, the cameras and screens are activated, the recording of the user is performed when the "single" button is pressed, a plurality of users compete with each other in the same hall when the "multi" button is pressed, when the "universal" button is pressed the server matches single or multiple contests, worldwide depending on the preference of the user (the match ups are determined according to the parameters selected by the user. When the multi or universal option is activated, the shots and data of each contestant are reflected on the hall screens. The contest data is recorded separately to the accounts of users as such as in the single user option.)

(When one of the options of the contest (multi or universal) is activated, the users, shots and data are shown on the screen of each opponent. Similar to single user shots, the contests are also recorded to the ID of users separately).

when the "live" button is clicked, single/multi or universal shots are shared live with followers/friends, each shot is converted into time, distance, speed, angle etc, in terms of shooting technique, and the data are analyzed arithmetically and geometrically, the recorded data are recorded into the "Analysis" file in order for the users to observe the data, in the "Tactics" file, the theoretical and practical training materials (guides, video etc.) are presented to the user.

The users can use their own national languages in the interactive sports training method subject to the invention. The method subject to the invention allows users to socialize with other people in the virtual world. In another embodiment of the method subject to the invention, the system comprises features like adding and removing friends, making comments, sending messages, like/dislike options similar to other social media platforms.

In the method subject to the invention the user's account can be a secure account. By this means the personal data of the users are confidential. By means of the method subject to the invention the users can delete or organize their own videos.

The invention claimed is:

1. An interactive sports training system configured for playing football comprising:

a football platform, a football post located on the football platform, the football post comprising a plurality of hinges configured to allow the football post to be opened and closed by being folded, wherein the football post height and width are adjustable, a pair of telescopic net carrier structures each connected to respective side nets, the pair of telescopic mesh carrier structures provided on the football platform, a plurality of metal net bars, each metal net bar hingedly connected to one of the telescopic net carrier structures, and providing connection of the side nets with each respective telescopic net carrier structure, a plurality of wheels positioned under each telescopic net carrier structure, a plurality of score plates positioned behind the football post, each score plate comprising:

a metal back plate, a back circuit layer provided on the metal back plate, a resistive touch layer located on the back circuit layer, an LED layer located on the resistive touch layer, a protective plastic layer located on the LED layer, and a metal housing frame located on the protective plastic layer, wherein the resistive touch layer of each score plate is configured to detect an impact of a football and each LED layer of each score plate is configured to display a point score when the respective resistive touch layer of the respective score plate detects the impact, a score board configured to be connected to the internet, and a video recorder camera mounted to a distal end of a metal net bar of the plurality of metal net bars, wherein the video recorder is configured to record the motions of a user and the score board is configured to display the scores that a user has obtained.

* * * * *